US006959569B2

(12) United States Patent
Strader et al.

(10) Patent No.: US 6,959,569 B2
(45) Date of Patent: Nov. 1, 2005

(54) RE-KEYABLE LOCK ASSEMBLY

(75) Inventors: Walter Strader, Coto de Caza, CA (US); Steven Armstrong, Anaheim Hills, CA (US); Gerald B. Chong, Rowland Heights, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/888,454

(22) Filed: Jul. 9, 2004

(65) Prior Publication Data

US 2005/0016234 A1 Jan. 27, 2005

Related U.S. Application Data

(63) Continuation-in-part of application No. 10/256,066, filed on Sep. 26, 2002, now Pat. No. 6,860,131.

(51) Int. Cl.[7] ..... E05B 27/04; E05B 29/04

(52) U.S. Cl. ..... 70/492; 70/383; 70/384; 70/493; 70/495

(58) Field of Search ..... 70/337–343, 382–385, 70/368, 492, 493, 495

(56) References Cited

U.S. PATENT DOCUMENTS

| | | | | |
|---|---|---|---|---|
| 1,565,556 A | | 12/1925 | Fremon | |
| 1,610,224 A | | 12/1926 | Dalboni et al. | |
| 1,965,889 A | | 7/1934 | Fitzgerald | |
| 2,139,842 A | | 12/1938 | Miller | |
| 2,194,469 A | | 3/1940 | Fremon | |
| 2,232,017 A | | 2/1941 | Wilder | |
| 2,370,862 A | | 12/1945 | Johnstone | |
| 2,391,832 A | | 12/1945 | Johnstone | 70/367 |
| 2,895,323 A | * | 7/1959 | Kennedy | 70/383 |
| 2,977,786 A | | 4/1961 | Kendrick et al. | |
| 3,149,486 A | | 9/1964 | Russell et al. | |
| 3,183,692 A | | 5/1965 | Check | |
| 3,190,093 A | | 6/1965 | Schlage | |
| 3,320,781 A | | 5/1967 | Hill | |
| 3,589,153 A | | 6/1971 | Hill | 70/384 |
| 3,667,262 A | * | 6/1972 | Hill | 70/384 |
| 3,726,116 A | | 4/1973 | Dimotta | 70/378 X |
| 3,728,880 A | | 4/1973 | Falk | 70/382 X |
| 3,735,612 A | | 5/1973 | Popovici | 70/38 A |
| 3,754,422 A | | 8/1973 | Stackhouse | 70/377 X |
| 3,910,083 A | * | 10/1975 | Burlingame | 70/383 |
| 3,990,282 A | | 11/1976 | Sorum | 70/377 X |
| 3,999,413 A | | 12/1976 | Raymond et al. | 70/377 X |
| 4,015,458 A | | 4/1977 | Mercurio | 70/377 X |
| 4,069,694 A | | 1/1978 | Raymond et al. | 70/337 |

(Continued)

FOREIGN PATENT DOCUMENTS

| | | |
|---|---|---|
| EP | 0157967 | 10/1985 |
| EP | 0210037 | 1/1987 |
| EP | 0872615 | 10/1988 |
| WO | WO 93/14290 | 7/1993 |
| WO | WO 97/36072 | 10/1997 |

*Primary Examiner*—Lloyd A. Gall
(74) *Attorney, Agent, or Firm*—Carlson, Gaskey & Olds

(57) ABSTRACT

A re-keyable lock cylinder includes a plug body and a carrier sub-assembly disposed adjacent the plug body. The plug assembly includes a plurality of planar wafers and the carrier sub assembly includes a plurality of racks for engaging the wafers in a face-to-face teeth arrangement. The racks disengage from the wafers to separate the teeth in response to movement of the carrier such that the lock cylinder is in a re-keyable condition when the racks are disengaged from the wafers.

20 Claims, 13 Drawing Sheets

U.S. PATENT DOCUMENTS

| | | | | | |
|---|---|---|---|---|---|
| 4,094,175 | A | | 6/1978 | Pechner | 70/383 X |
| 4,142,391 | A | | 3/1979 | Paig | 70/461 |
| 4,320,639 | A | | 3/1982 | Kleefeldt et al. | 70/337 X |
| 4,372,139 | A | | 2/1983 | Laake | 70/383 |
| 4,376,382 | A | | 3/1983 | Raymond et al. | 70/338 |
| 4,377,940 | A | | 3/1983 | Hucknall | 70/378 X |
| 4,393,673 | A | | 7/1983 | Widen | 70/358 |
| 4,404,824 | A | | 9/1983 | Hennessy | 70/419 X |
| 4,412,437 | A | | 11/1983 | Smith | 40/338 |
| 4,440,009 | A | | 4/1984 | Smith | 70/385 |
| 4,689,978 | A | | 9/1987 | Drummond | 70/431 |
| 4,712,399 | A | | 12/1987 | Mattossovich | 70/383 X |
| 4,712,401 | A | | 12/1987 | Monahan | 70/382 |
| 4,712,402 | A | | 12/1987 | Monahan | 70/383 |
| 4,729,231 | A | | 3/1988 | Wu | 70/383 |
| 4,732,023 | A | | 3/1988 | Shen | 70/383 |
| 4,741,188 | A | | 5/1988 | Smith | 70/383 |
| 4,747,281 | A | | 5/1988 | Monahan | 70/383 |
| 4,765,163 | A | | 8/1988 | Trull et al. | 70/224 |
| 4,794,772 | A | | 1/1989 | Falk et al. | 70/491 |
| 4,836,002 | A | | 6/1989 | Monahan | 70/382 |
| 4,850,210 | A | | 7/1989 | Adler et al. | 70/383 |
| 4,899,563 | A | | 2/1990 | Martin | 70/367 |
| 4,909,053 | A | | 3/1990 | Zipf, III et al. | 70/283 |
| 4,912,953 | A | | 4/1990 | Wobig | 70/383 |
| 4,920,774 | A | | 5/1990 | Martin | 70/367 |
| 4,942,749 | A | | 7/1990 | Rabinow | 70/495 |
| 4,966,021 | A | | 10/1990 | Boag | 70/383 |
| 4,996,856 | A | | 3/1991 | Lin et al. | 70/359 |
| 5,010,753 | A | | 4/1991 | Boris, Jr. | 70/371 |
| 5,024,071 | A | | 6/1991 | Shafirkin | 70/387 |
| 5,038,589 | A | | 8/1991 | Martin | 70/368 |
| 5,044,180 | A | | 9/1991 | Lebrecht | 70/48 |
| 5,076,081 | A | | 12/1991 | Boris, Jr. | 70/398 |
| 5,121,619 | A | | 6/1992 | Martin | 70/371 |
| 5,174,136 | A | | 12/1992 | Thwing | 70/38 A |
| 5,209,088 | A | | 5/1993 | Vaks | 70/384 |
| 5,211,044 | A | | 5/1993 | Kim | 70/371 |
| 5,233,850 | A | | 8/1993 | Schroeder | 70/337 |
| 5,325,690 | A | | 7/1994 | Adler et al. | 70/383 |
| 5,428,978 | A | | 7/1995 | Tsukano | 70/386 |
| 5,431,034 | A | | 7/1995 | Fann et al. | 70/369 |
| 5,540,071 | A | | 7/1996 | Reikher | 70/495 |
| 5,640,865 | A | | 6/1997 | Widen | 70/495 |
| 5,704,234 | A | | 1/1998 | Resch | 70/371 |
| 5,718,136 | A | | 2/1998 | Aldieri et al. | 70/385 |
| 5,752,400 | A | | 5/1998 | Kim | 70/368 |
| 5,765,417 | A | | 6/1998 | Bolton | 70/495 |
| 5,791,181 | A | | 8/1998 | Sperber et al. | 70/383 |
| 5,884,512 | A | | 3/1999 | Wayne | 70/370 |
| 5,921,122 | A | | 7/1999 | Lin | 70/368 |
| 5,921,123 | A | | 7/1999 | Schwarzkopf et al. | 70/371 |
| 5,970,760 | A | | 10/1999 | Shen | 70/371 |
| 5,979,200 | A | | 11/1999 | Cliff | 70/491 |
| 6,029,484 | A | | 2/2000 | Jetton | 70/371 |
| 6,047,577 | A | * | 4/2000 | Klimas | 70/340 |
| 6,076,386 | A | | 6/2000 | Etchells et al. | 70/369 |
| 6,079,240 | A | | 6/2000 | Shvarts | 70/367 |
| 6,119,495 | A | | 9/2000 | Loreti | 70/340 |
| 6,134,928 | A | | 10/2000 | Kang | 70/394 |
| 6,142,717 | A | | 11/2000 | Staiger | 408/115 R |
| 6,295,850 | B1 | | 10/2001 | Anderson | 70/492 |
| 6,425,274 | B1 | | 7/2002 | Laitala et al. | 70/394 |
| 6,516,643 | B1 | * | 2/2003 | Olshausen | 70/337 |
| 6,523,378 | B2 | | 2/2003 | Kuo | 70/360 |
| 6,532,782 | B2 | | 3/2003 | Chiu | 70/369 |
| 6,564,601 | B2 | | 5/2003 | Hyatt, Jr. | 70/278.3 |
| 6,860,131 | B2 | * | 3/2005 | Armstrong et al. | 70/492 |
| 2003/0037582 | A1 | | 2/2003 | Edwards, Jr. et al. | 70/495 |
| 2003/0084692 | A1 | * | 5/2003 | Herdman | 70/338 |
| 2003/0089149 | A1 | * | 5/2003 | Suzuki et al. | 70/492 |
| 2003/0154753 | A1 | | 8/2003 | Dimig et al. | 70/495 |
| 2004/0069030 | A1 | | 4/2004 | Takadama | 70/495 |

* cited by examiner

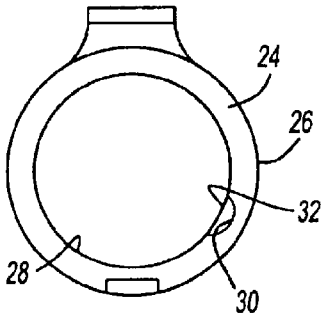
Fig-3A
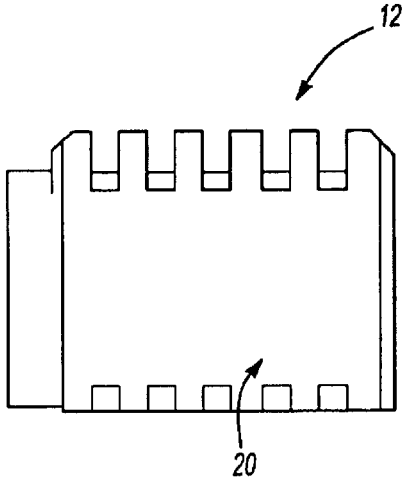
Fig-3B
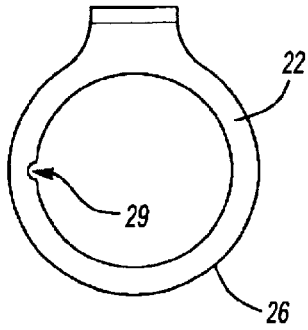
Fig-3C
Fig-3D
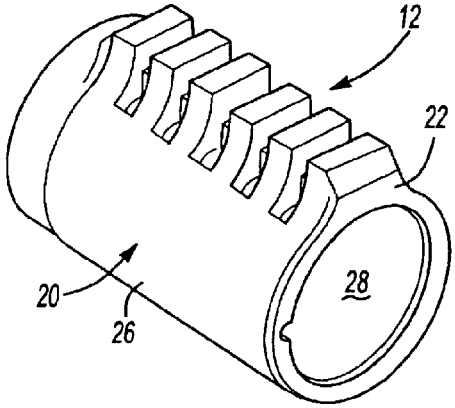
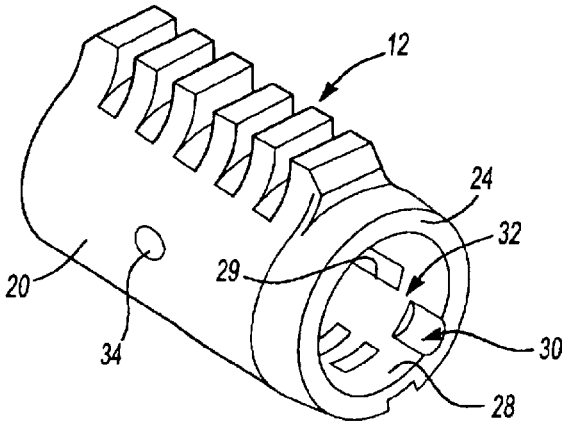
Fig-3E Fig-5A
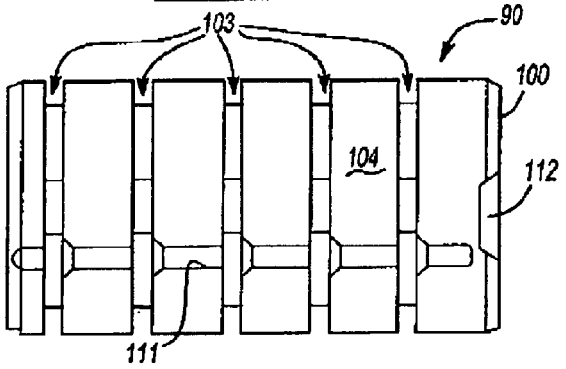
Fig-5B
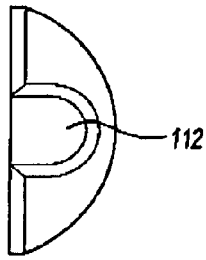
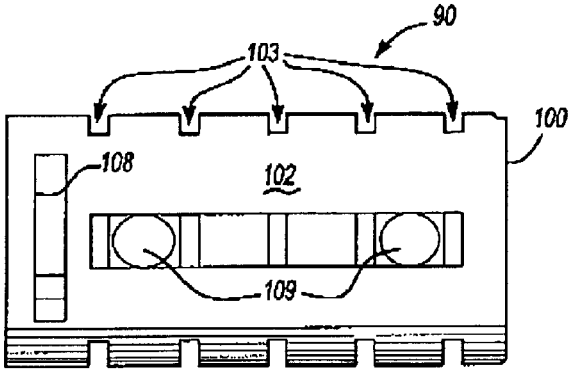
Fig-5C
Fig-5D
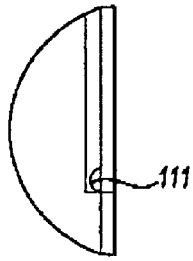
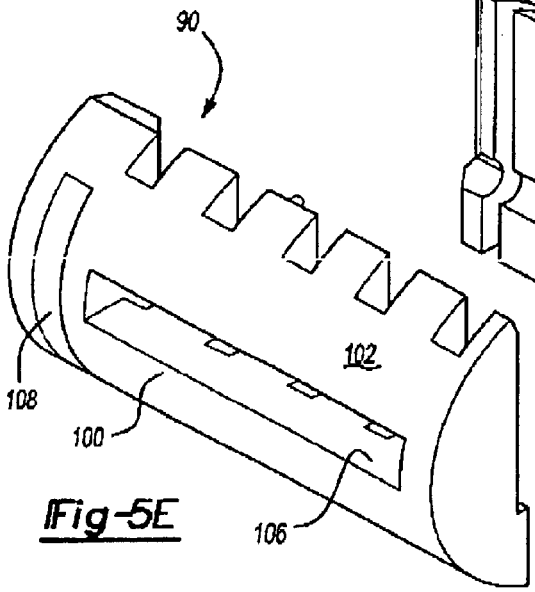
Fig-5E
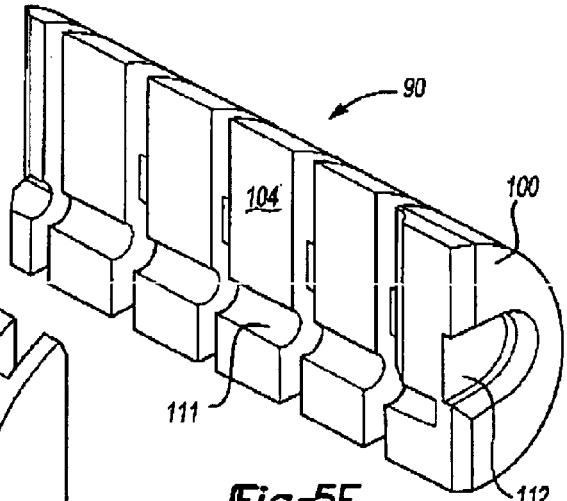
Fig-5F

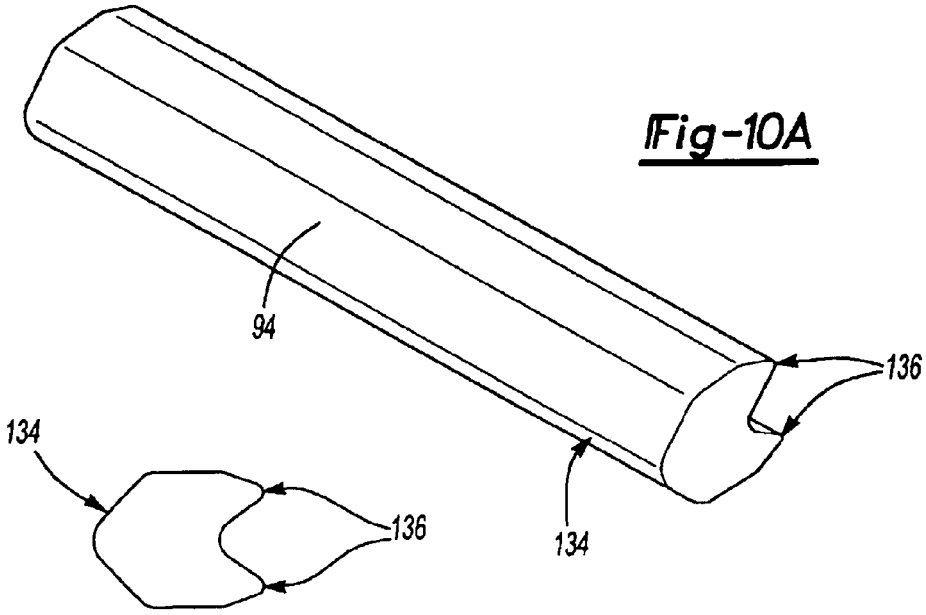
Fig-10A
Fig-10B
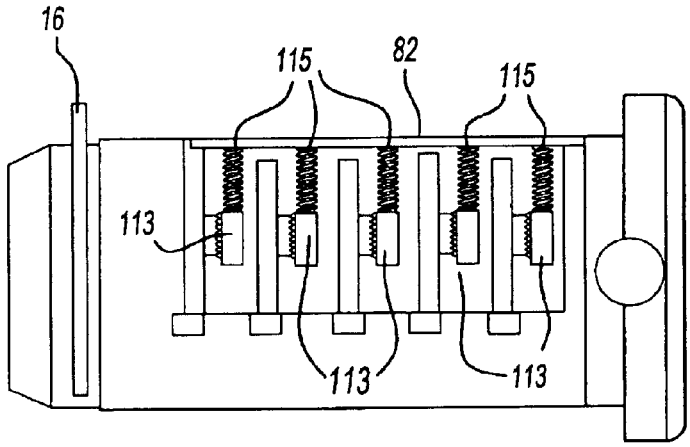
Fig-11
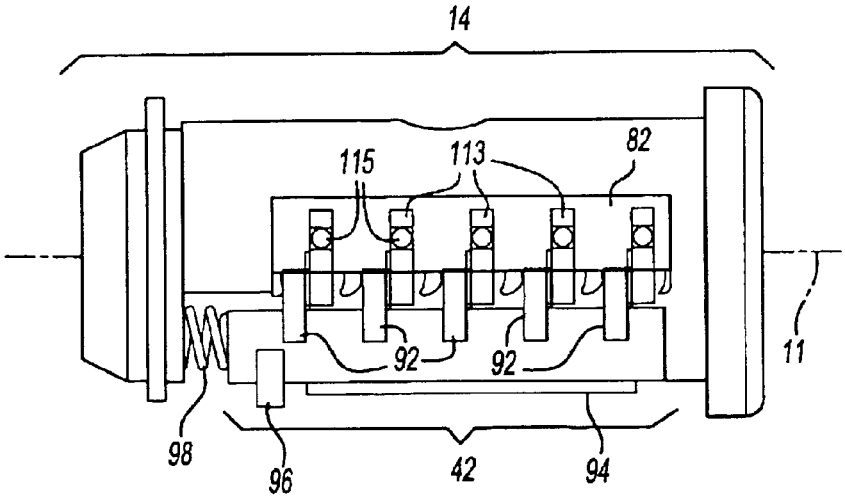
Fig-12

RE-KEYABLE LOCK ASSEMBLY

The present invention is a continuation-in-part of U.S. patent application Ser. No. 10/256,066, filed Sep. 26, 2002, now U.S. Pat. No. 6,860,131.

BACKGROUND OF THE INVENTION

The present invention relates to a wafer-tumbler lock, and more particularly to a rekeyable wafer-tumbler lock with facially engageable wafer tumblers.

Most common locks are pin-tumbler cylinder locks or wafer tumbler cylinder locks. Each of these locks contains a cylinder or plug which rotates within a housing or shell. In the pin-tumbler locks, pin holes containing top and bottom pin tumblers extend transversely through both the cylinder and the housing crossing a shear line, which is the boundary between the cylinder and the housing. The pin tumblers slide up and down within the pin holes defining a locked position and an unlocked position. When a pin tumbler crosses the shear line, the pin tumbler interferes with the rotation of the cylinder and the cylinder remains locked. When the correct key is inserted in the lock, the biting on the key contacts the pin tumblers and locates the pins within their pin holes such that no pin crosses the shear line. The cylinder can then rotate within the housing when a torque is applied by the key to unlock the lock.

Wafer-tumbler locks have wafer-shaped tumblers which slide up and down within channels that extend from the cylinder to the housing. The wafer tumblers are spring loaded so that they can extend out of the cylinder and into a locking slot within the housing, to prevent rotation of the cylinder relative to the housing in a locked condition. The center of each of the wafer tumblers has an opening for receiving a key. The correct key moves the wafer tumblers out of the locking slot, such that torque applied to the cylinder rotates the cylinder within the housing and unlocks of the lock.

To avoid or reduce the costs of re-keying locks, several types of re-keyable locks that do not require disassembly have been developed for pin-tumbler locks. However, uncomplicated and cost effective re-keyable locks for wafer tumbler systems are still relatively uncommon.

Accordingly, it is desirable to provide an inexpensive re-keyable wafer-tumbler lock assembly.

SUMMARY OF THE INVENTION

The re-keyable lock cylinder according to the present invention provides a re-keyable lock cylinder will learn a new key while obsolescing old keys without disassembly thereof. According to the present invention, a re-keyable lock cylinder comprises a cylinder body with a longitudinal axis and a plug assembly disposed in the cylinder body. The plug assembly includes a plug body and a carrier sub-assembly disposed adjacent the plug body. The plug assembly further includes a plurality of planar wafers. The carrier sub-assembly is moveable parallel to the longitudinal axis of the cylinder body and includes a plurality of racks for engaging the wafers in a face-to-face teeth arrangement. The racks disengage from the wafers to separate the teeth in response to movement of the carrier in a first direction and engage the teeth in response to movement of the carrier in a second direction. The lock cylinder is in a re-keyable condition when the racks are disengaged from the wafers.

The present invention further includes a novel method of re-keying the re-keyable lock cylinder. According to the invention, a method of re-keying the cylinder includes providing a lock cylinder with a plug body and a lock face having a keyway and a tool-receiving aperture, inserting a first valid key in the keyway, rotating the plug body to a first position, inserting a tool in the tool-receiving aperture, removing the first valid key from the keyway, inserting a second valid key in the keyway, and rotating the plug body away from the first position. The step of inserting the tool includes the step of moving each rack out of engagement with each wafer such that the rack teeth become repositioned on the wafer teeth in response to the second valid key.

The present invention therefore provides an inexpensive re-keyable wafer-tumbler lock assembly.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIGS. 3A–3E are various views of a cylinder body for use in the present invention;

FIGS. 5A–5F are various view of the carrier for use in the present invention;

FIGS. 10A–10B are views of a locking bar for use in the present invention;

FIG. 11 is a partially broken away side view of the plug assembly;

FIG. 12 is a top plan view of the plug assembly in an engaged position;

DETAILED DESCRIPTION OF THE PREFERRED EMBODIMENT

Figure 1:
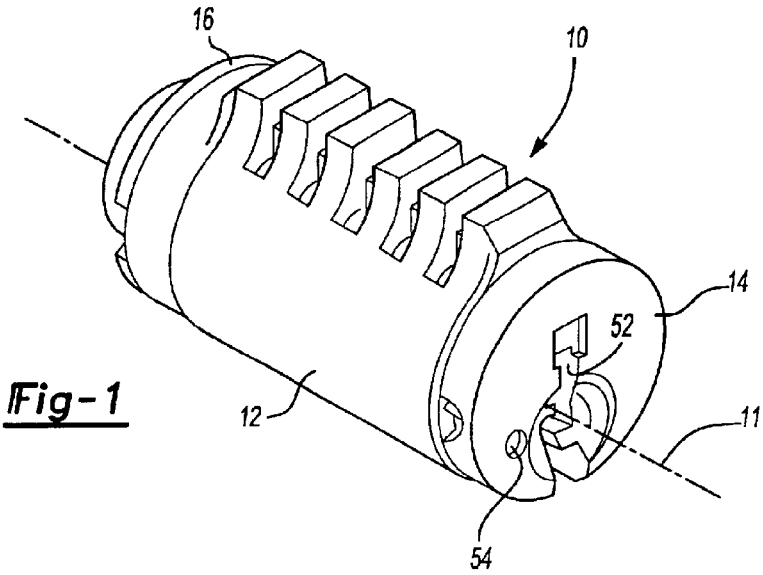
FIG. 1 is perspective view of a lock cylinder according to the present invention.

FIG. 1 illustrates a general perspective view of a lock cylinder 10. The lock cylinder 10 includes a longitudinal axis 11, a lock cylinder body 12, a plug assembly 14 and a retainer 16.

Figure 2:
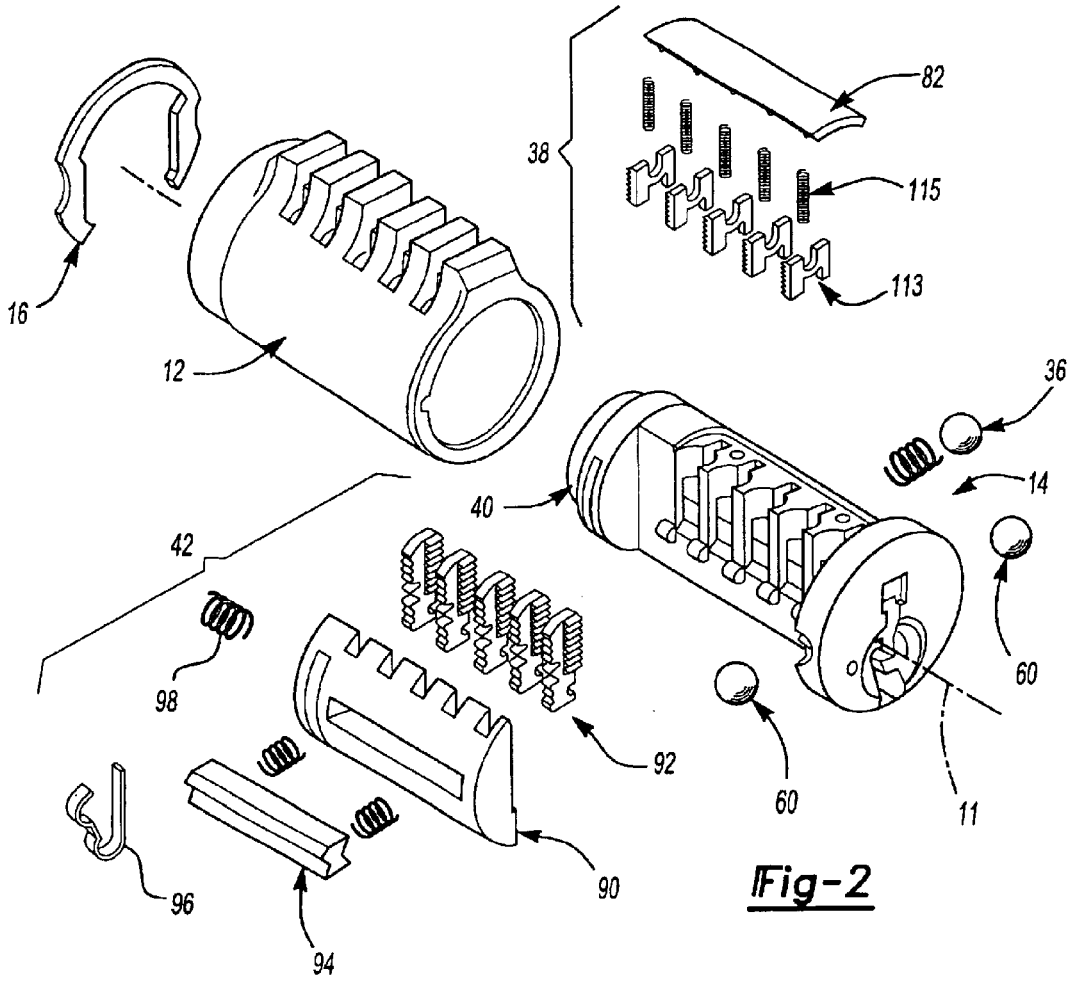
FIG. 2 is an exploded perspective view of a lock assembly according to the present invention.
Figure 4A:
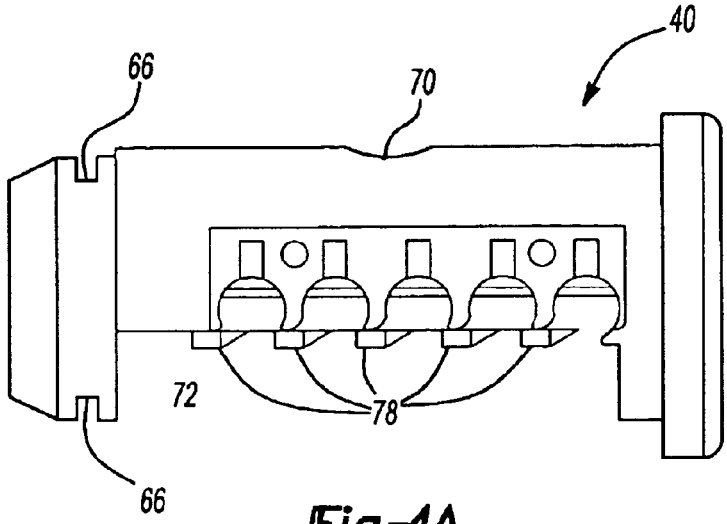
FIGS. 4A–4F are various views of the cylinder plug body for use in the present invention.
Figure 4B:
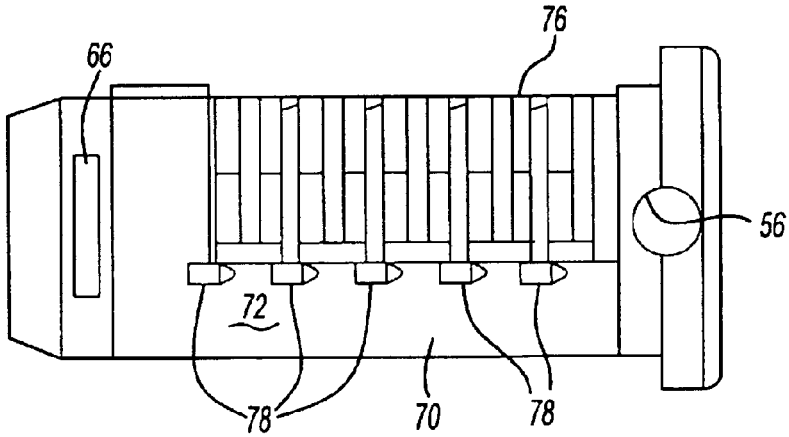
Figure 4C:
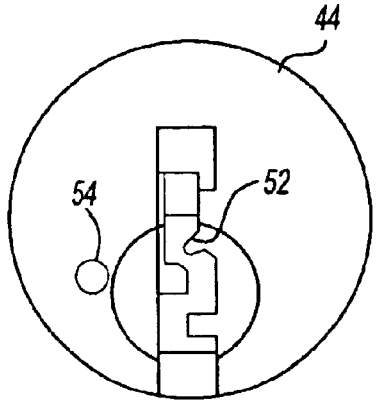
Figure 4D:
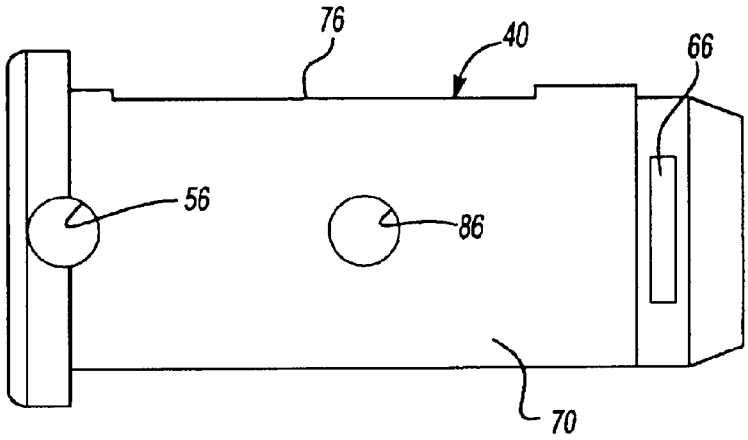
Figure 4E:
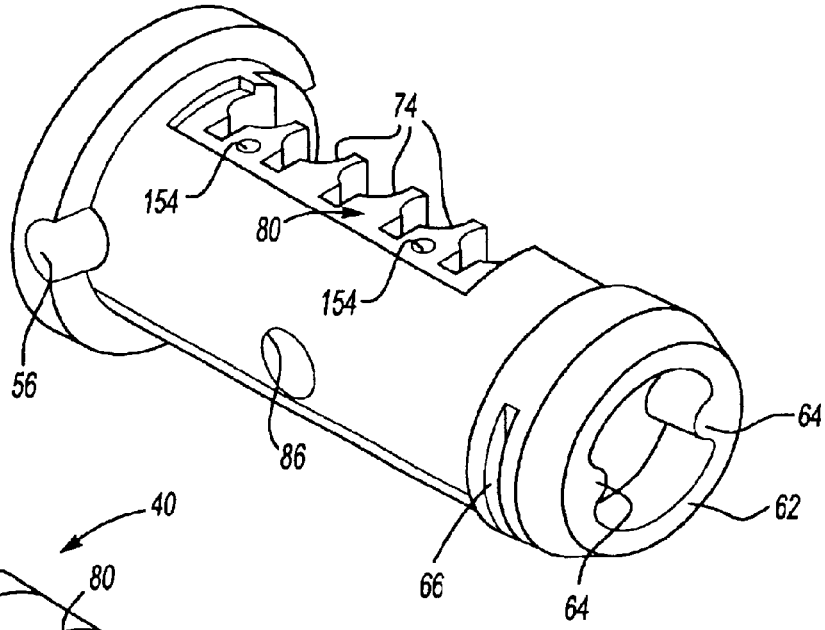
Figure 4F:
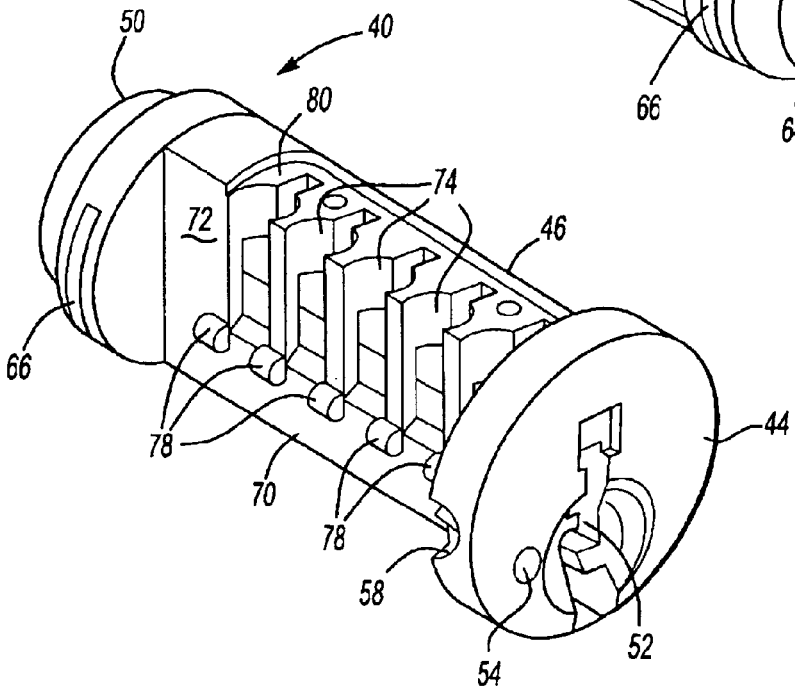

Referring to FIG. 2, the lock cylinder body 12 (FIGS. 3A–3E), includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32 (FIG. 3E). The generally V-shaped locking bar-engaging groove 29 extends longitudinally along a portion of the cylinder body 12 from the front end 22. The first detent recess 30 is disposed at a back end 24 and extends to a first depth. The second detent recess 32 is disposed adjacent the first detent recess 30 and extends to a lesser depth. A detent bore 34 extends radially through the cylinder wall 26 for receiving a detent ball 36.

Figure 6A:
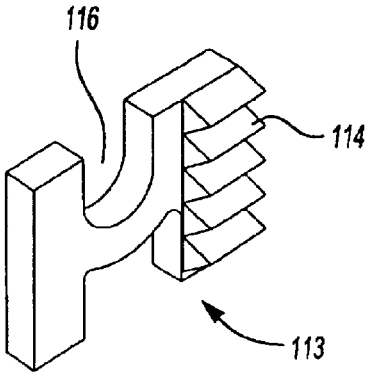
FIGS. 6A–6B are views of a wafer for use in the present invention.
Figure 6B:
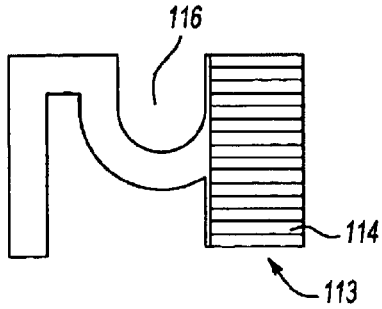

The plug assembly 14 includes a plug body 40 (FIGS. 4A–4F), a carrier sub-assembly 42 (FIGS. 5A–5F) and a plurality of spring-loaded wafers 38 (FIGS. 6A–6B). The plug body 40 (FIGS. 4A–4F) includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60 or the like.

The drive portion 50 (FIG. 4F) includes an annular wall 62 with a pair of opposed projections 64 extending radially inwardly (FIG. 4E) to drive a spindle or torque blade (neither shown). The drive portion 50 further includes a pair of slots 66 formed in its perimeter for receiving the retainer 16 to retain thc plug body 40 in the cylinder body 12. The intermediate portion 46 includes a main portion 70 formed as a cylinder section and having a first planar surface 72 and a plurality of channels 74 for receiving the spring-loaded wafers 38. The channels 74 extend transversely to the longitudinal axis 11 of the plug body 40 and parallel to the planar surface 72. A second planar surface 76 extends perpendicular to the first planar surface 72 and defines a recess 80 for receiving a retaining cap 82 (FIGS. 7A–7D). The channels 74 extend at least partially through the plug body 40, with thc sidewalls of the channels open to the first planar surface 72. The first planar surface 72 further includes a plurality of bullet-shaped, rack-engaging features 78. A bore 86 for receiving a spring detent ball 36 extends radially inwardly from opposite the first planar surface 72.

The carrier sub-assembly 42 includes a carrier 90 (FIGS. 5A–5E), a plurality of racks 92 (FIGS. 8A–8B), a spring catch 96 (FIGS. 9A–9B), a spring-loaded locking bar 94 (FIGS. 10A–10B), and a return spring 98. The carrier 90 includes a body 100 in the form of a cylinder section that is complementary to the main portion 70 of the plug body 40, such that the carrier 90 and the main portion 70 combine to form a cylinder that fits inside the lock cylinder body 12. The carrier 90 includes a curved surface 102 and a flat surface 104. The curved surface 102 includes a locking bar recess 106 and a spring catch recess 108.

The locking bar recess 106 further includes a pair of return spring-receiving bores 109 (FIG. 5C) for receiving the locking bar return springs. The flat surface 104 includes a plurality of parallel rack receiving slots 103 extending perpendicular to the longitudinal axis of the carrier 90. A semi-circular groove 111 extends along the flat surface 104 parallel to the longitudinal axis of the carrier 90. The back end of the carrier 90 includes a return spring recess 112 for receiving the return spring 98.

Each spring-loaded wafer assembly 38 includes a wafer 113 and a biasing spring 115. The wafer 113 provides a spring pocket 116 (FIGS. 6A–6B) for receiving biasing springs 115 to bias each wafer toward the bottom of the keyway 52 (FIG. 11). The wafers 113 (FIGS. 6A–6B) are preferably generally planar members with a set of wafer teeth 114 formed on a planar face of the wafer 113. That is, the wafer teeth 114 are located transverse to the axis 11 and face toward the keyway. The wafer teeth 114 are receivable with the teeth 122 on each of the racks 92 in a face-to-face orientation generally transverse to axis 11 (FIG. 12). The wafer teeth 114 are preferably separated by a distance which is commensurate with bit distances for a key.

The racks 92 (FIGS. 8A–8B) include a pin engaging surface 118 having a plurality of rack teeth 122. The racks 92 are preferably generally planar members with the set of rack teeth 122 formed on a planar face of the wafer 113. The set of rack teeth 122 are located transverse to the axis 11 and face away the keyway 52. The rack teeth 122 are configured to engage the wafer teeth 114 (FIG. 12) in a face-to-face engagement transverse to the axis 11.

The spring-loaded locking bar 94 (FIGS. 10A–10B) is sized and configured to fit in the locking bar recess 106 in the carrier 90 and includes a triangular edge 134 configured to fit in the V-shaped locking bar engaging groove 29. Opposite the triangular edge 134, the locking bar 94 includes a pair of longitudinally extending gear teeth 136 configured to engage the locking bar-engaging grooves 132 formed in the racks 92.

The spring-retaining cap 82 includes a curvilinear portion 140 having an upper surface 142 and a lower surface 144 (FIGS. 7A–7D). The thickness of the curvilinear portion 140 preferably allows the curvilinear portion 14 to fit in the recess 80 with the upper surface 142 flush with the intermediate portion 46 of the plug body 40. A plurality of spring alignment tips 146 extend from the lower surface 144 to engage the springs 115. In addition, a pair of cap retaining tips 152 extend from the lower surface 144 to engage alignment openings 154 formed in the plug body 40.

Figure 8A:
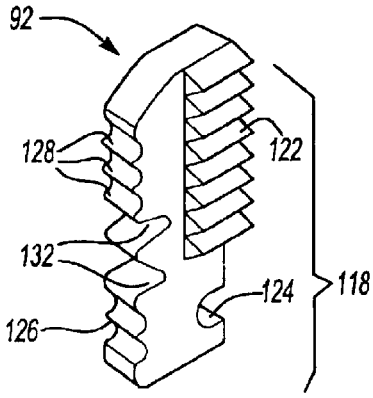
FIGS. 8A–8B are views of a rack for use in the present invention.
Figure 8B:
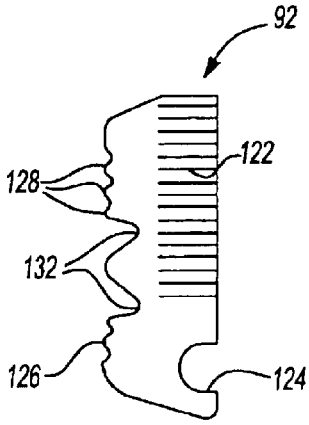
Figure 9A:
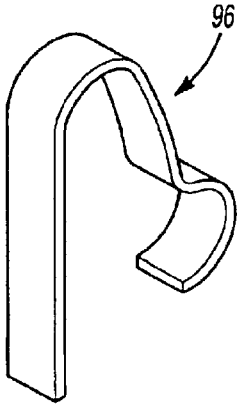
FIGS. 9A–9B are views of a spring catch for use in the present invention.
Figure 9B:
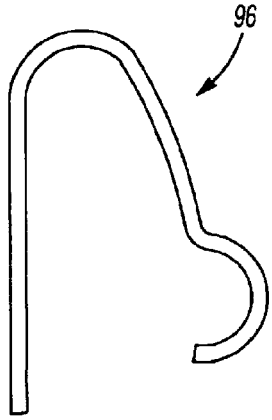
Figure 7A:
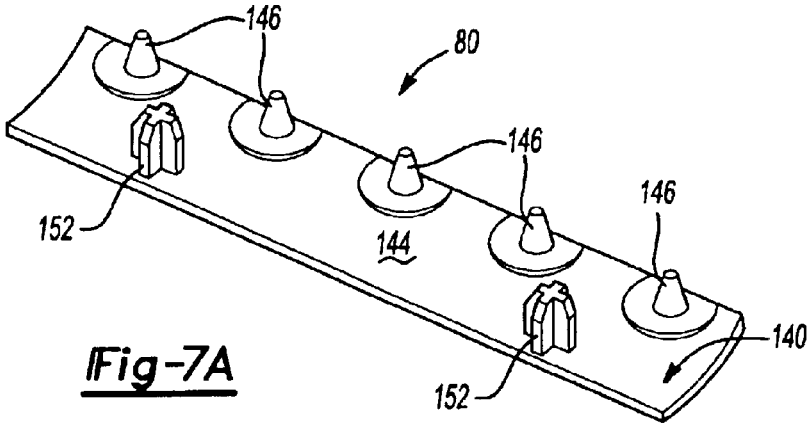
FIGS. 7A–7D are views of a spring retaining cap for use in the present invention.
Figure 7B:
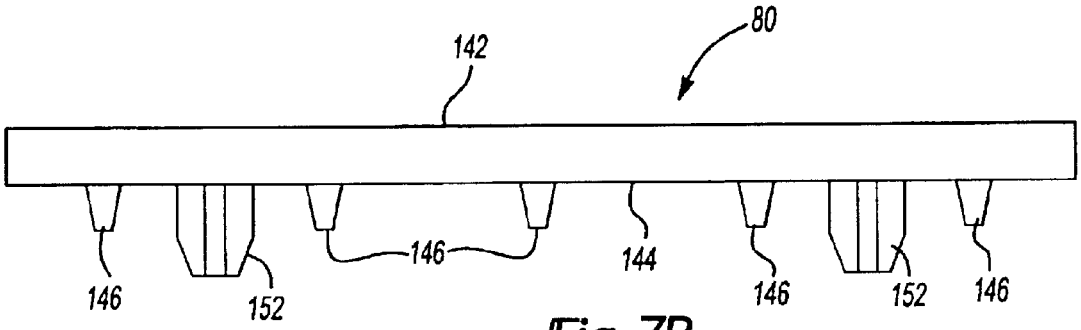
Figure 7C:
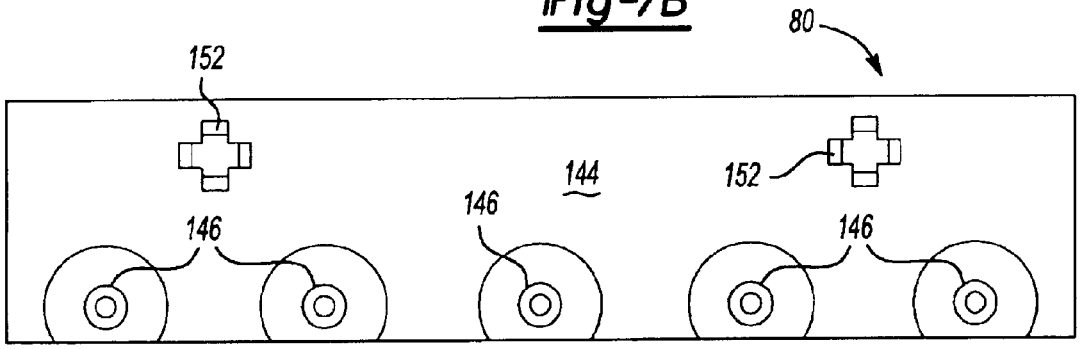
Figure 7D:
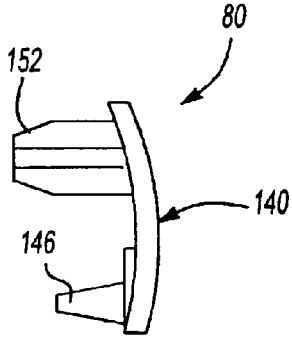
Figure 13:
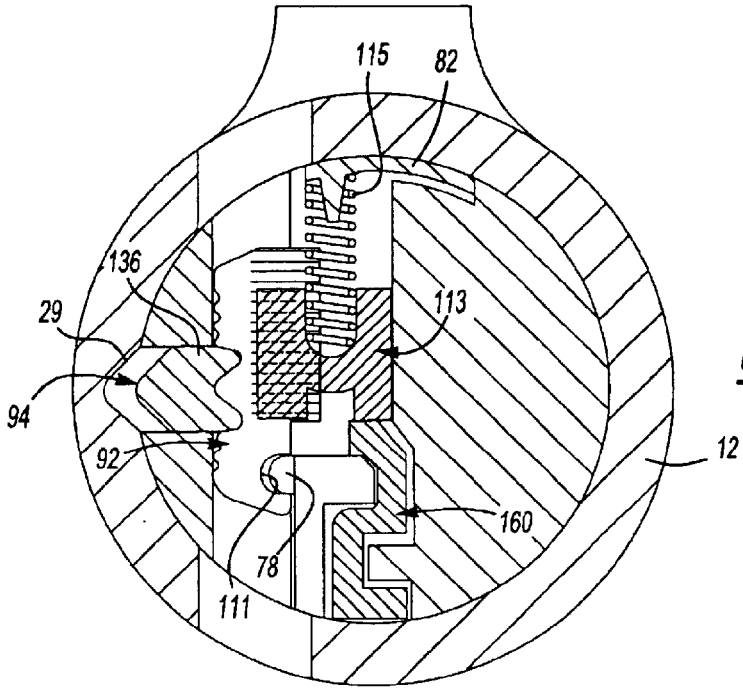
FIG. 13 is a section view through the plug assembly and a cylinder body, the section being taken transversely at one of the wafers to illustrate the positioning of the wafer, the rack, and the locking bar relative to each other and the cylinder body in an unlocked configuration.

Referring to FIG. 13, the racks 92 also define a semi-circular recess 111 for engaging the bullet-shaped, rack-engaging features 78 on the planar surface 72 (FIGS. 8A–8B). The racks 92 further include a second surface 126 that includes a plurality of anti-pick grooves 128 and a pair of locking bar-engaging grooves 132. It should be understood that various rack shapes will be applicable to the present invention.

Figure 14:
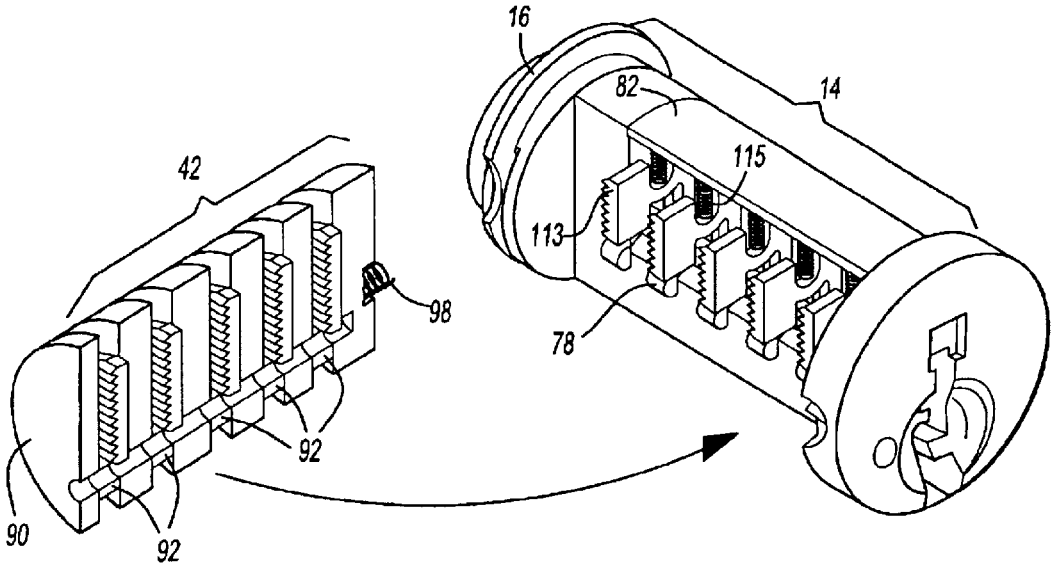
FIG. 14 is a partially exploded view of the plug assembly.

Referring to FIG. 14, to assemble the lock cylinder 10, the wafers 113 and springs 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 103 and the spring-loaded locking bar 94 into the locking bar recess 106, with the gear teeth 136 engaging the locking bar-engaging grooves 132 formed in the racks 92. The spring catch 96 is disposed in the spring catch recess 108 of the carrier 90.

Figure 15:
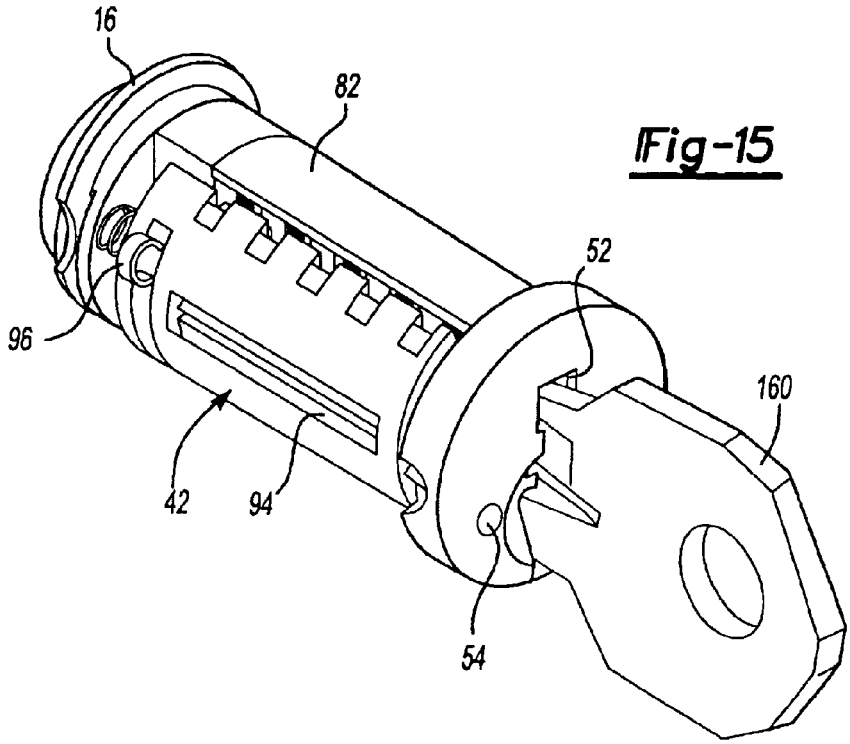
FIG. 15 is a perspective view of the plug assembly with a valid key inserted therein and illustrating the locking bar disposed in an unlocking position to allow the plug assembly to rotate in the lock cylinder body.
Figure 16:
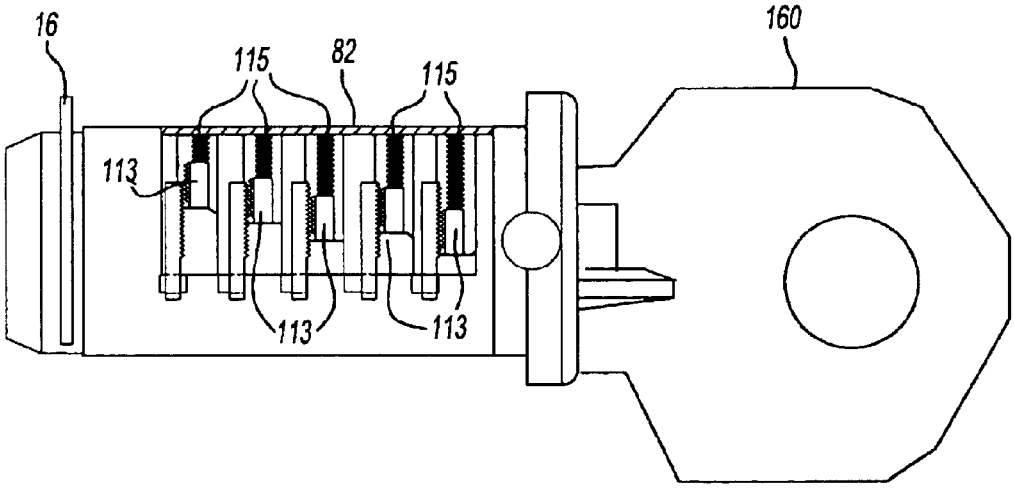
FIG. 16 is a partially exploded side view of the plug assembly with a first valid key inserted.
Figure 17:
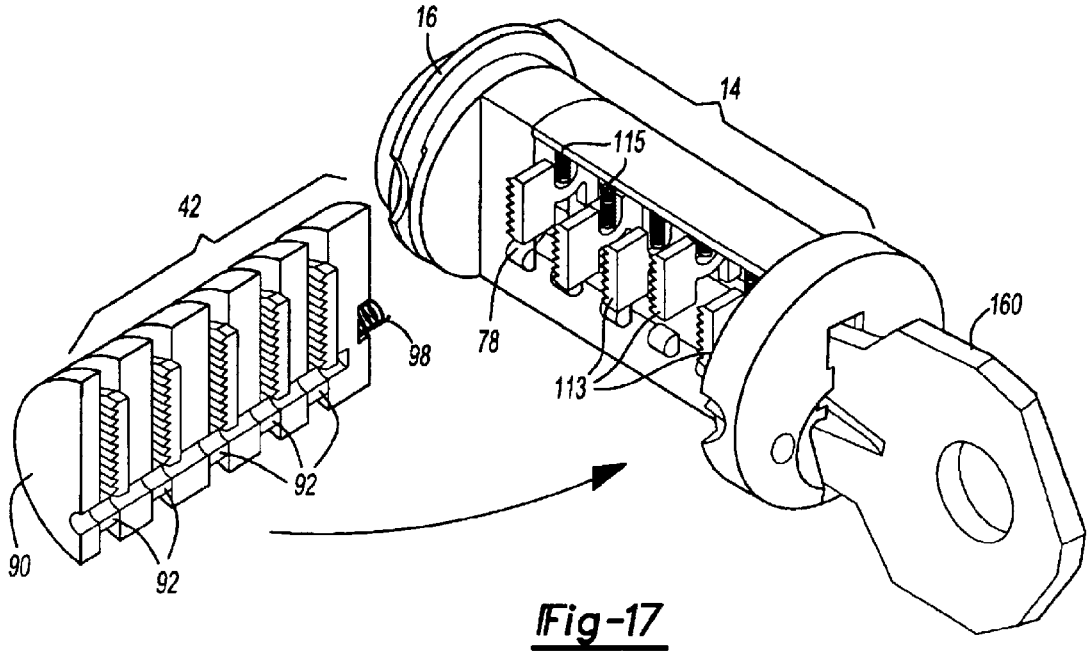
FIG. 17 is a partially broken away side view of the plug assembly with the first valid key inserted.

Referring to FIG. 15, a valid key 160 is inserted into the keyway 52 such that the wafers 113 are located in response to the bits of the valid key 160 (FIG. 16). The return spring 98 is compressed into the return spring recess 112, and the carrier sub-assembly is placed adjacent the plug body 40 (FIG. 17). The plug assembly 14 is placed in the lock cylinder body 12 and the retainer 16 is disposed in the slots 66 formed in the plug body 40 to retain the plug assembly 14 in the cylinder body 12. The racks 92 at heights related to the bits of the valid key 160 are then mated to the wafers 113 such that the rack teeth 122 engage the wafer teeth 114. The lock cylinder 10 is now keyed to the valid key 160.

The internal configuration of a lock cylinder 10 with the valid key 160 inserted therein at the home position permits the locking bar 94 to be free to cam out of the groove 29 in the cylinder body 12 (FIG. 13). The bits of the valid key 160 lift the wafers 113 in the channels 74 and thereby re-position the racks 92 in the slots 103. When repositioned, the racks 92 are disposed to align the locking grooves 132 with the extended gear teeth 136 on the locking bar 94. The locking bar 94 is free to cam out of the groove 29 when the valid key 160 is rotated. At the same time, the bullet-shaped features 78 are aligned with the semi-circular grooves 111 in the racks 92 (FIG. 5), allowing the racks 92, and the carrier 90, to move parallel to the longitudinal axis of the lock cylinder 10.

Figure 18:
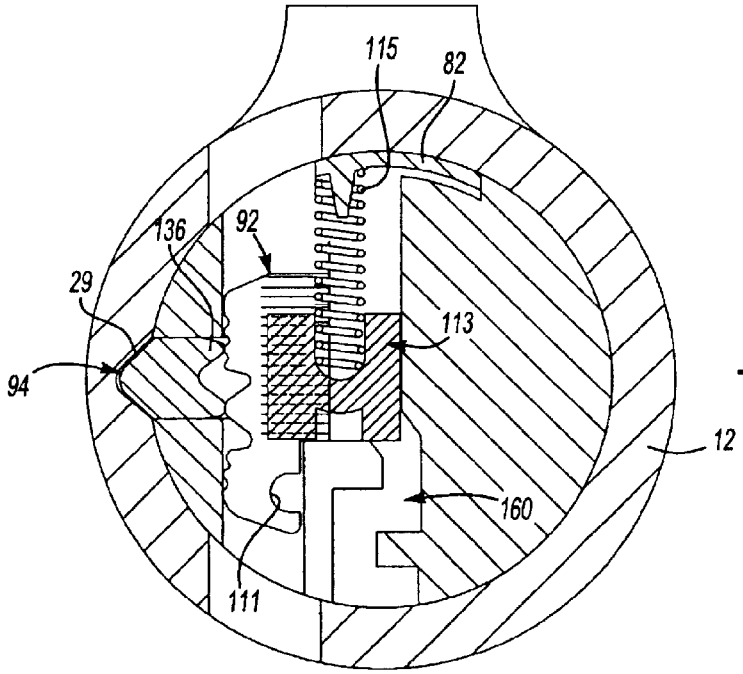
FIG. 18 is a section view through the plug assembly and a cylinder body, the section being taken transversely at one of the wafers and illustrating the positioning of the wafer, a rack, and the locking bar relative to each of the cylinder body in a locked configuration.

Referring to FIG. 18, the properly keyed lock cylinder 10, without the valid key 160 inserted biases the wafers 113 to the bottom of the channels 74 and, based on the cut of the valid key 160, the racks 92 are disposed at various positions in the slots 102 of the carrier 90. In this configuration, the locking bar 94 extends from the carrier 90 to engage the groove 29 in the cylinder body 12 to prevent the plug assembly 14 from rotating in the cylinder body 12. In addition, the bullet-shaped features 78 are misaligned with the semi-circular grooves 111 in the racks 92 and therefore interfere with movement of the racks 92 parallel to the longitudinal axis of the lock cylinder 10, preventing the lock cylinder 10 from being rekeyed.

Figure 19:
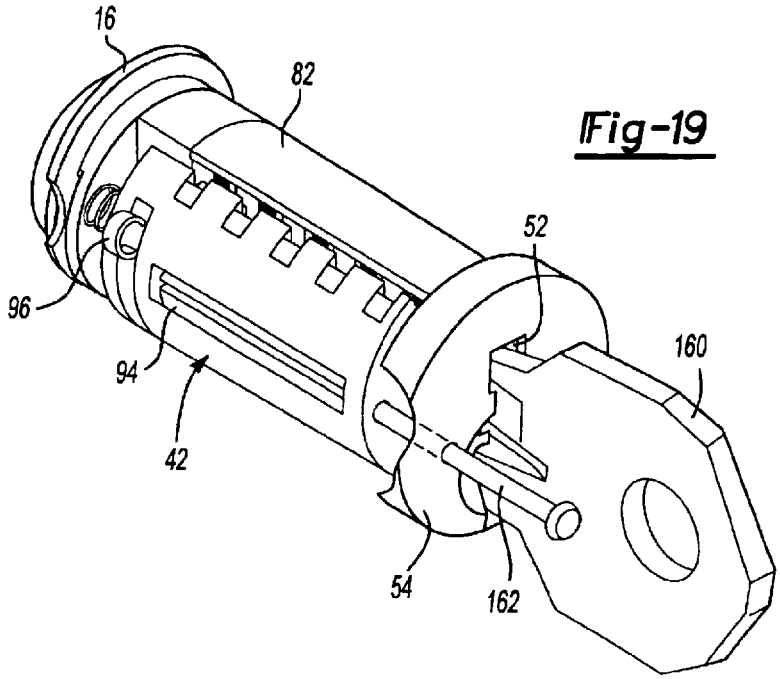
FIG. 19 is a perspective view similar to FIG. 15 but with the carrier assembly moved axially to a rekeying position.

Referring to FIG. 19, the lock cylinder 10 is prepared to be re-keyed. The valid key 160 is inserted into the keyway 52, and rotated approximately 45° counterclockwise from the home position until the spring catch 96 moves into the second detent recess 32 formed in the cylinder body 12 (FIG. 3E). A tool 162 is inserted into the tool opening 54 and pushed against the carrier 90 to move the carrier 90 parallel to the longitudinal axis of the lock cylinder 10 until the spring catch 96 moves into the first detent recess 30, and the tool 162 is removed.

Figure 20:
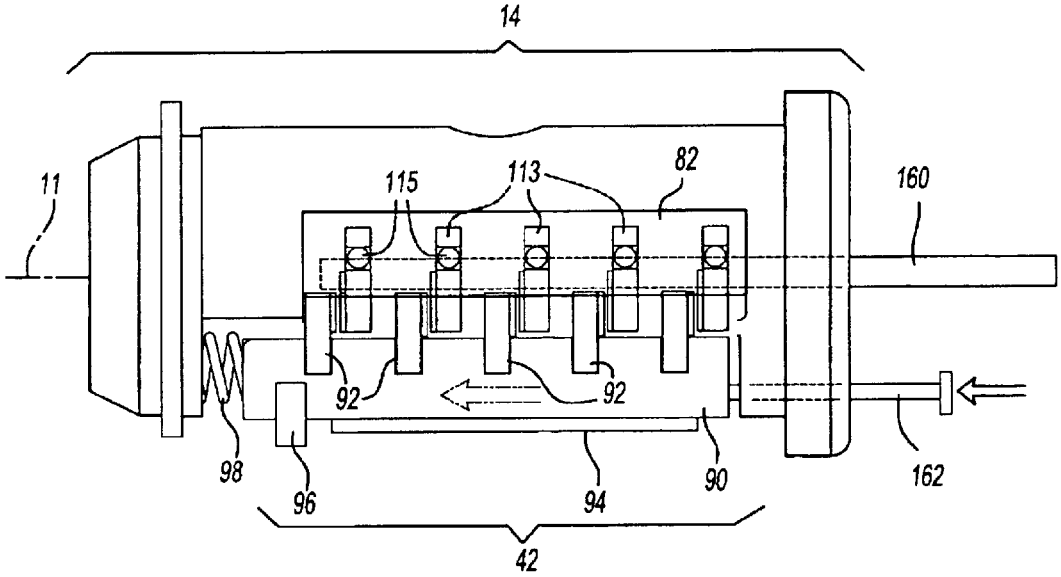
FIG. 20 is a top plan view of the plug assembly in a re-keying position.
Figure 21:
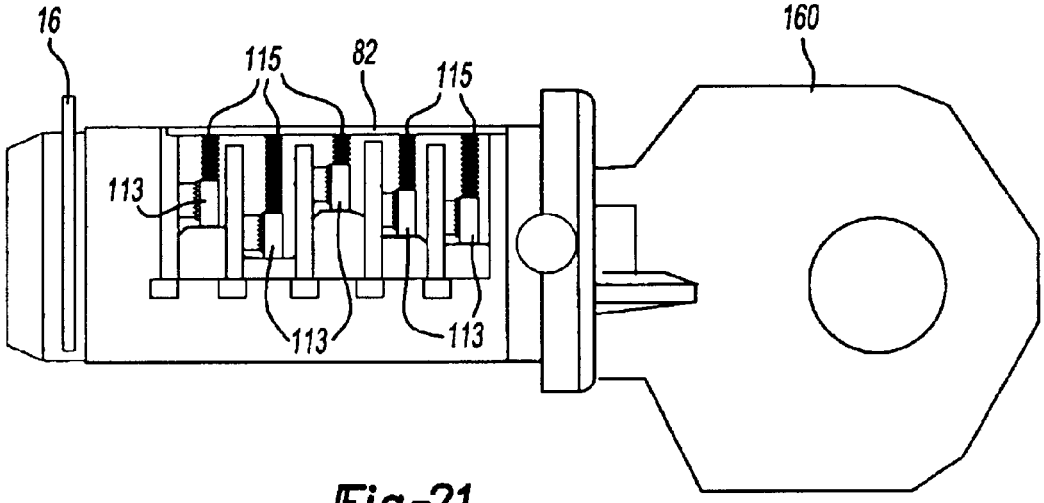
FIG. 21 is a sectional view of the plug assembly with a second valid key inserted.

With the spring catch 96 disposed in the first detent recess 30, the racks 92 are longitudinally disengaged from the wafers 113 parallel to axis 11 (FIG. 20). That is, the rack teeth 122 are displaced longitudinally parallel to axis 11 such that the rack teeth 122 do not contact the wafer teeth 114. The valid key 160 is removed and a second valid key is inserted and rotated clockwise to release the spring catch 96. As the spring catch 96 leaves the first detent recess 30, the carrier 90 is driven toward the plug face 44 by the return spring 98, causing the racks 92 to re-engage the wafer teeth 114 of the wafers 113 at different positions based on the bits of the second valid key (FIG. 21). At this point, the lock cylinder 10 is keyed to the second valid key and the first valid key 160 no longer operates the lock cylinder 10.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A re-keyable lock cylinder comprising:

a cylinder which defines a longitudinal axis;

a plug receivable within the cylinder;

a wafer slidably mountable within said plug transverse said axis;

a carrier mountable adjacent said plug, said carrier selectively movable parallel to said axis; and a rack slidably mountable within said carrier, said rack engageable with said wafer.

2. The re-keyable lock cylinder as recited in claim 1, wherein said wafer and said rack are substantially planar members.

3. The re-keyable lock cylinder as recited in claim 2, wherein said wafer has a multiple of wafer teeth and said rack has a multiple of rack teeth, said rack teeth engageable with said wafer teeth.

4. The re-keyable lock cylinder as recited in claim 3, wherein said rack teeth are engageable with said wafer teeth in a facial relationship.

5. The re-keyable lock cylinder as recited in claim 3, wherein said rack teeth are engageable with said wafer teeth such that said wafer at least partially overlaps said rack relative said axis.

6. The re-keyable lock cylinder as recited in claim 1, further comprising a biasing member to bias said wafer toward a keyway.

7. The re-keyable lock cylinder as recited in claim 1, wherein said carrier defines a slot to slidably support said rack.

8. The re-keyable lock cylinder as recited in claim 1, wherein said carrier is slidable parallel to said axis when said wafer and said rack are positioned at a predetermined position.

9. The re-keyable lock cylinder as recited in claim 8, wherein said predetermined position is defined by a valid key.

10. The re-keyable lock cylinder as recited in claim 1, wherein said carrier and said plug are rotatable relative said cylinder when said wafer and said rack are positioned at a predetermined position.

11. The re-keyable lock cylinder as recited in claim 10, further comprising a locking bar selectively engageable with locking bar engagement groove formed in said rack.

12. The re-keyable lock cylinder as recited in claim 11, wherein said locking bar extends out of a locking bar engaging groove in said cylinder when said locking bar extends into said locking bar engagement groove formed in said rack.

13. A re-keyable lock cylinder comprising:

a cylinder which defines a longitudinal axis;

a plug receivable within the cylinder;

a wafer slidably mountable within said plug transverse said axis;

a biasing member to bias said wafer toward a keyway;

a carrier mountable adjacent said plug; and a rack slidably mountable within said carrier, said rack facially engaged with said wafer, said plug and carrier rotatable relative said cylinder in response to a valid key being located in said keyway to position said wafer and said rack in a predetermined position said carrier axially displaceable parallel to said axis when said wafer and said rack are positioned at said predetermined position.

14. The re-keyable lock cylinder as recited in claim 13, wherein said wafer has a multiple of wafer teeth and said rack has a multiple of rack teeth, said rack teeth engageable with said wafer teeth to reposition said wafer relative said rack in response to a second key within said keyway when said carrier is axially displaced relative said plug.

15. The re-keyable lock cylinder as recited in claim 14, further comprising a locking bar which extends out of a locking bar engaging groove in said cylinder when said locking bar extends into a locking bar engagement groove formed in said rack.

16. The re-keyable lock cylinder as recited in claim 15, wherein said locking bar maintains said rack in a first position while said wafer is repositioned relative said rack in response to said second key within said keyway when said carrier is axially displaced relative said plug.

17. A method of re-keying a lock cylinder comprising the steps of:

(1) inserting a first key into a keyway of a plug parallel to an axis;

(2) longitudinally displacing a carrier relative the plug parallel to the axis from a first position to a second position to longitudinally separate a rack in the carrier from a wafer in the plug;

(3) removing the first key;

(4) inserting a second key into the keyway;

(5) returning the carrier to the first position.

18. A method as recited in claim 17, wherein said step (2) further comprises the step of:

separating a set of rack teeth from a facially engageable set of wafer teeth.

19. A method as recited in claim 18, further comprises the step of:

repositioning the engagement of the set of wafer teeth relative the set of rack teeth in response to the second key.

20. A method as recited in claim 17, further comprises the step of:

rotationally positioning the plug and the carrier to a predetermined position relative a cylinder prior to said step (2).

* * * * *